US010794602B2

(12) United States Patent
Choi

(10) Patent No.: US 10,794,602 B2
(45) Date of Patent: Oct. 6, 2020

(54) COOKING APPLIANCE

(71) Applicant: LG ELECTRONICS INC., Seoul (KR)

(72) Inventor: Moonho Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 671 days.

(21) Appl. No.: 15/151,854

(22) Filed: May 11, 2016

(65) Prior Publication Data

US 2016/0334114 A1 Nov. 17, 2016

(30) Foreign Application Priority Data

May 12, 2015 (KR) ..... 10-2015-0065907

(51) Int. Cl.

| | |
|---|---|
| ***F24C 15/34*** | (2006.01) |
| ***F24C 15/16*** | (2006.01) |
| ***F24C 15/18*** | (2006.01) |
| ***F24C 1/04*** | (2006.01) |

(52) U.S. Cl.

CPC ..... *F24C 15/34* (2013.01); *F24C 15/168* (2013.01); *F24C 15/18* (2013.01); *F24C 1/04* (2013.01)

(58) Field of Classification Search

CPC combination set(s) only.
See application file for complete search history.

(56) References Cited

U.S. PATENT DOCUMENTS

| | | | | |
|---|---|---|---|---|
| 2009/0224643 | A1* | 9/2009 | Kouchi | G03G 21/1647 312/334.44 |
| 2013/0020308 | A1* | 1/2013 | Cha | F24C 15/18 219/394 |
| 2013/0028544 | A1* | 1/2013 | Lowe | A47B 88/047 384/21 |
| 2017/0143118 | A1* | 5/2017 | Azkue | A47B 88/463 |

FOREIGN PATENT DOCUMENTS

| | | |
|---|---|---|
| JP | 2009-079831 | 4/2009 |
| JP | 2011-089738 | 5/2011 |

* cited by examiner

*Primary Examiner* — Steven B McAllister
*Assistant Examiner* — Elizabeth M. May
(74) *Attorney, Agent, or Firm* — Fish & Richardson P.C.

(57) ABSTRACT

A cooking appliance includes a cabinet that defines an exterior of the cooking appliance, a cooking unit provided within the cabinet, the cooking unit configured to perform cooking using a first heat source, a drawer provided under the cooking unit, the drawer configured to perform cooking using a second heat source and to be inserted in and withdrawn from the cabinet, and a damping module configured to absorb a closing shock transmitted to the drawer based on the drawer being closed by being inserted into the cabinet.

13 Claims, 9 Drawing Sheets

COOKING APPLIANCE

Pursuant to 35 U.S.C. § 119(a), this application claims the benefit of earlier filing date and right of priority to Korean Application No. 10-2015-0065907, filed on May 12, 2015, the contents of which are hereby incorporated by reference herein in their entirety.

FIELD

The present disclosure relates to a cooking appliance. Although the present disclosure is suitable for a wide scope of applications, it is particularly suitable for absorbing shock on closing a drawer provided to the cooking appliance and also enabling the drawer to be automatically closed to a fully-closed position of the drawer from a preset insertion position of the drawer.

BACKGROUND

Generally, cooking appliances can refer to appliances capable of cooking food using electricity or other energy (e.g., gas, etc.).

Among such cooking appliances, cooking appliances using gas as heat source include a gas range, a gas oven, a gas oven range, and the like, and cooking appliances using electricity as heat source include an induction range, a radiant heater using electric range, an electronic range, and the like. In some cases, a combined cooking appliance combines an electricity-based induction range with a gas-based gas oven.

For instance, in case of a gas oven range, a gas range can be disposed as a first cooking unit on an upper part, and a gas oven can be disposed as a second cooking unit under the gas range.

As another example, in case of an electric oven range, an electric range, an induction range, or the like can be disposed as a first cooking unit on an upper part, and an electric oven can be disposed as a second cooking unit on a lower part.

More recently, the demand for a cooking appliance having a third cooking unit of a drawer type provided under the second cooking unit is rising, in order to further improve user convenience.

For example, FIG. 1 illustrates a drawer that may be provided to a cooking appliance. Further referring to FIG. 1, a drawer 1 provided to a cooking appliance of the may include a drawer housing 2 forming a cooking space, a front panel 3 provided in front of the drawer housing 2, a handle 4 provided to the front panel 3, a heater installation part 8 protruding from a top panel 7, which covers a topside of the drawer housing 2, upward and convexly, a heater 9 provided to the heater installation part 8, and a cabinet configured to enclose a lateral side and a rear side of the drawer 1.

The drawer 1 may be configured to be withdrawn from (i.e., opened) or inserted into (i.e., closed) the cabinet by being pulled or pushed by a user. In doing so, when the drawer 1 is closed by being pushed, a vessel accommodated in the drawer 1 may be distressed by the shock of the drawer 1 on the cabinet or the like, or in some cases food contained in the vessel may be damaged by such a shock. Moreover, it may be inconvenient for a user to maintain a grip on the handle 4 provided to the drawer 1 until the drawer 1 is fully closed in order to mitigate the shock when the drawer 1 is closed.

SUMMARY

According to one aspect, a cooking appliance includes a cabinet that defines an exterior of the cooking appliance, a cooking unit provided within the cabinet, the cooking unit configured to perform cooking using a first heat source, a drawer provided under the cooking unit, the drawer configured to perform cooking using a second heat source and to be inserted in and withdrawn from the cabinet, and a damping module configured to absorb a closing shock transmitted to the drawer based on the drawer being closed by being inserted into the cabinet.

Implementations according to this aspect may include one or more of the following features. For example, the damping module may be configured to absorb the closing shock of the drawer during the insertion of the drawer from a preset insertion position to a fully inserted position. The damping module may be configured to automatically close the drawer by moving the drawer in a closing direction. A slider may be provided to each of both lateral sides of the drawer, and a guide part may be configured to guide the slider to thereby allow sliding movement between the slider and the guide part is provided within the cabinet. The damping module may be provided at one side of the guide part and may be oriented to be parallel with the guide part. In some cases, the damping module and the guide part may be spaced apart from each other by a preset interval, and at least one end portion of both end portions of the damping module and the guide part may be fixed to each other by at least one bracket to maintain the preset interval. Each of both of the end portions of the damping module may be fixed to a location corresponding to the guide part by the fixing bracket. Additionally, the fixing bracket may include a first fixing bracket and a second fixing bracket, a first end portion of the damping module may be fixed to a rear end portion of the guide part by the first fixing bracket, and a second end portion of the damping module may be fixed to a preset location between a front end portion and the rear end portion of the guide part by the second fixing bracket.

In some implementations, a link member may be provided to the slider, and the damping module may be provided with a holding member that is configured to selectively engage with the link member at a preset insertion position of the drawer. The damping module may include a hydraulic damper configured to absorb the closing shock of the drawer during the insertion of the drawer from the preset insertion position to a fully inserted position, and an elastic unit configured to move the drawer in a closing direction from the preset insertion position of the drawer, the elastic member being oriented to be parallel with the hydraulic member, wherein a front end portion of the hydraulic damper and a front end portion of the elastic unit may be fixed to the holding member. The hydraulic damper may include a first body and a piston rod configured to reciprocate in and out of the first body, the elastic unit may include a second body and an elastic member accommodating in at least one portion of the second body, and a first guide slot having a preset length may be defined in the second body to guide a first projection provided to the holding member. The first body and the second body may be integrally formed with each other. In some cases, the second guide slot may include a first inclined plane inclined at a preset first inclination angle with reference to a virtual line in parallel with the guide part and a second inclined plane inclined upward at a preset second inclination angle from a front end of the first inclined plane, and the second inclination angle of the second inclined plane may be greater than the first inclination angle of the first inclined plane. The second body may include a protruding portion that protrudes toward a rear side of the second body from a lower side of the second inclined plane to thereby restrict the second projection from being separated upward from the second guide slot.

Additionally, the holding member may be provided with a first locking portion and a second locking portion spaced apart from each other in a preset interval along a length direction of the holding member, and the link member may be provided with a third locking portion configured to engage between the first locking portion and the second locking portion at the preset insertion position of the drawer. Also, the second projection may be provided to a front end of the first locking portion, and based on a rear end of the third locking portion of the link member pushing the second locking portion at the preset insertion position of the drawer, the second projection may be configured to be withdrawn from the second guide slot. Based on the drawer being withdrawn from a fully closed state, while the drawer is withdrawn to a preset withdrawal position, as the third locking portion of the link member engages between the first locking portion and the second locking portion, the holding member and the link member may be configured to maintain a mutually locked state, and at the preset withdrawal position of the drawer, the link member may be configured to be separated from the holding member based upon the second projection of the holding member being inserted into the second guide slot. The preset insertion position may be a position at which the second projection is inserted into the second guide slot, the preset withdrawal position may be a position at which the second projection is withdrawn from the second guide slot, and the preset insertion position and the preset withdrawal position may be identical to each other. In some cases, the third locking portion may define a fit slit configured to enable the first locking portion to be fitted along a length direction of the third locking portion by a shrink fit, and, based on the drawer being closed, while the third locking portion deviates from a location between the first locking portion and the second locking portion and while the drawer is pushed in a closing direction, as the first locking portion may be locked into the fit slit, the link member and the holding member are configured to engage with each other. The third locking portion may be symmetrically provided to each of both end portions of the link member with reference to a center of the link member.

BRIEF DESCRIPTION OF THE DRAWINGS

The accompanying drawings, which are included to provide a further understanding of the disclosure and are incorporated in and constitute a part of this application, illustrate implementation(s) of the disclosure and together with the description serve to explain the principle of the disclosure. The above and other aspects, features, and advantages of the present disclosure will become more apparent upon consideration of the following description of preferred implementations, taken in conjunction with the accompanying drawing figures. In the drawings.

DETAILED DESCRIPTION

Figure 1:
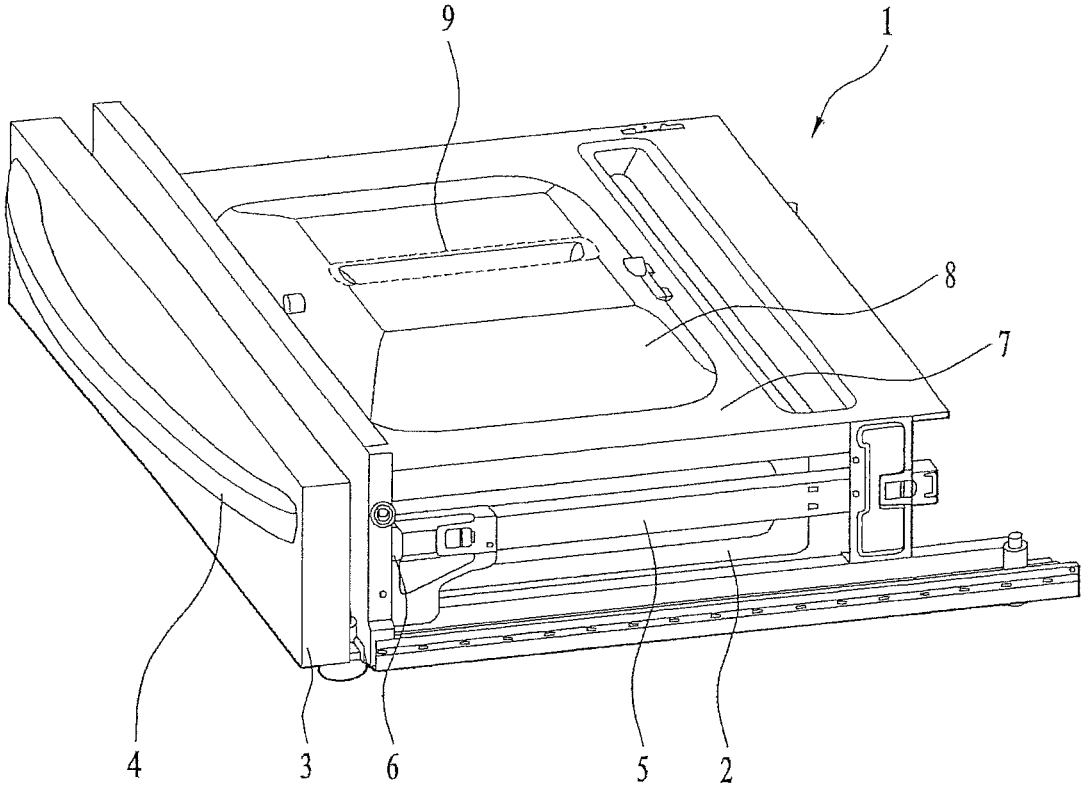
FIG. 1 is a perspective view illustrating a drawer provided to a cooking appliance.
Figure 2:
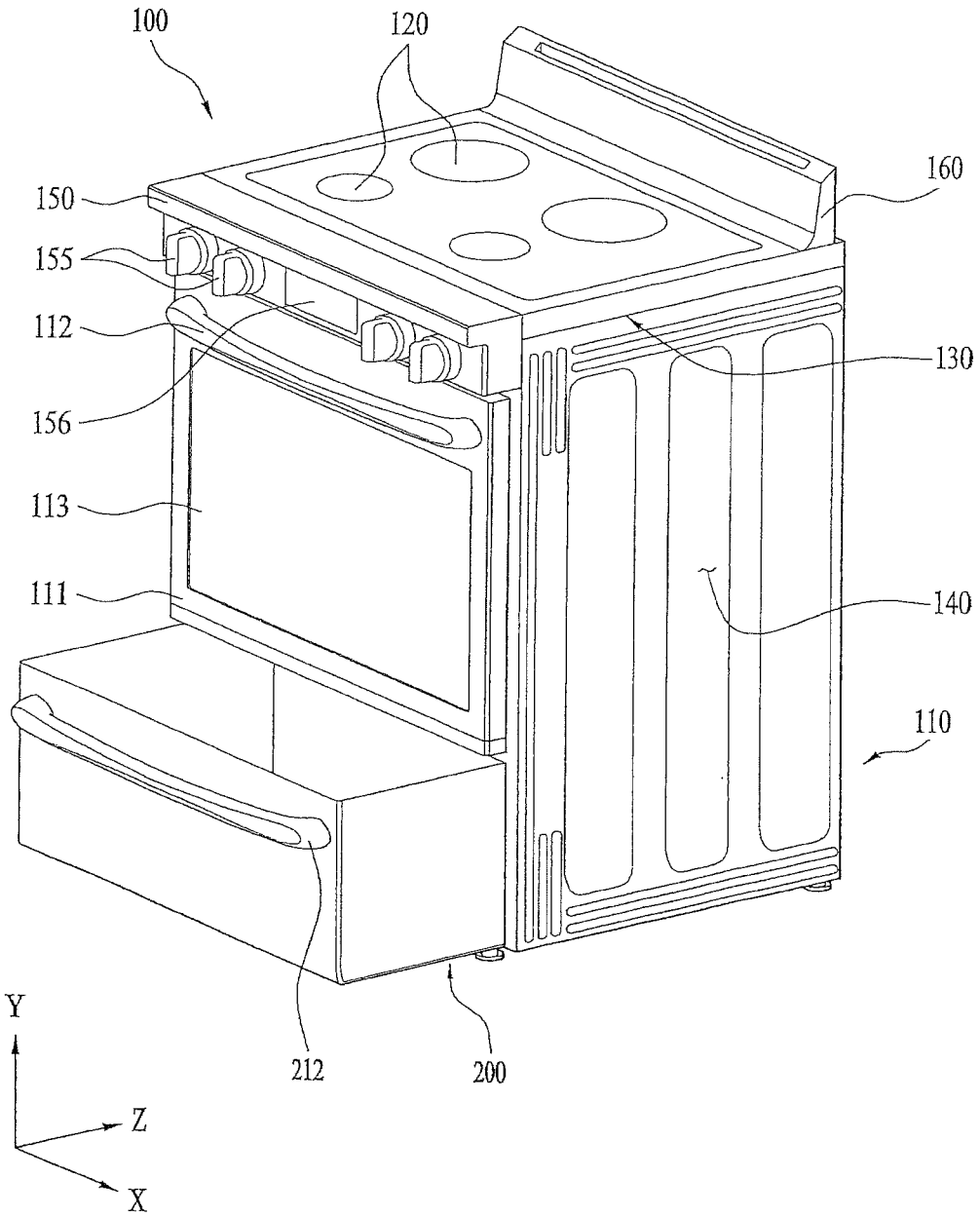
FIG. 2 is a perspective view of an example cooking appliance according to an implementation of the present disclosure.

FIG. 2 shows an example cooking appliance according to an implementation of the present disclosure. While in the following, for clarity of description, a cooking appliance using electricity as heat source is taken as one example, it is apparent that the features of the present disclosure are applicable to a cooking appliance using gas as heat source. Moreover, for clarity of description, it may be assumed in FIG. 2 that X-axial direction, Y-axial direction, and Z-axial direction are defined as a width direction, a height direction, and a forward-backward (or length) direction.

Referring to FIG. 2, a cooking appliance 100 may include a cabinet 110 forming an exterior, a top plate 130 disposed on a topside of the cabinet 110, the top place 130 provided with a first cooking unit 120, a second cooking unit 140 provided within the cabinet 110, a control panel 150 attached to a front side of the top plate 130, and a door 111 configured to open/close the second cooking unit 140 by being installed on a front side of the cabinet 110.

Moreover, the cooking appliance 100 according to the implementation of the present disclosure may further include a drawer 200 configured to be inserted in and also withdrawn from the cabinet 110 by being provided under the second cooking unit 140. A space for accommodating the second cooking unit 140 for performing a cooking using a heat source and the drawer 200 may be formed in the cabinet 110. The top plate 130 may be installed on the top side of the cabinet 110. And, the first cooking unit 120 for performing a cooking using a heat source may be provided to the top plate 130.

In this case, as the heat source of each of the first cooking unit 120 and the second cooking unit 140, electricity or gas can be used. For clarity of the description, a case of using the electricity as the heat source of the each of the first cooking unit 120 and the second cooking unit 140 is described in the following. For instance, an induction heating part or a radiant heating part may be provided to the first cooking unit 120. And, an electric heater may be provided to the second cooking unit 140.

As shown in FIG. 2, the control panel 150 may be disposed in front of the cabinet 110. In particular, the control panel 150 may be installed on the front side of the top plate 130. In more detail, the control panel 150 can be attached to the top plate 130 in a manner of being disposed over the door 111 provided to the front side of the cabinet 110 to open/close the second cooking unit 140.

The door 111 may be provided to the front side of the cabinet 110 to open/close the second cooking unit 140, and may be provided with a transparent part 113 configured to enable an inside of the second cooking unit 140 to be viewable and a handle part 112 configured to open/close the door 111.

A drawer handle part 212 may be configured to be gripped by a user on inserting or withdrawing the drawer 200 may be provided to a front side of the drawer 200. The drawer 200 may be usable to accommodate tableware or food or to heat or cook food. For clarity of the following description, the drawer 200 may be assumed as used for the usage in heating or cooking food-related items.

At least one manipulating unit 155 and a control command input unit 156 may be provided to the control panel 150. In some cases, the at least one manipulating unit 155 may be configured in form of a rotatable knob. Additionally, the control command input unit 156 may be configured as a touch-recognizable touch panel. Moreover, the control command input unit 156 may be configured to display information (e.g., a cooking course, a cooking time, etc.) on a cooking performed in the second cooking unit 140.

For instance, a user may be able to control the first cooking unit 120 through the manipulating unit 155 and may also be able to control the second cooking unit 140 and the drawer 200 through the display unit 156.

A controller that is configured to control the first cooking unit 120, the second cooking unit 130, and the drawer 200 may be provided to an inner space of the control panel 150 or in rear of the control panel 150.

Moreover, the cooking appliance 100 according to the implementation of the present disclosure may further include a rear panel 160 installed in rear of the top side of the cabinet 110. The rear panel 160 may be integrally formed with the top plate 130 or may be installed in rear of the top side of the cabinet 110.

As illustrated, the drawer 200 may be configured to be inserted in or withdrawn from the cabinet 110. The above-configured drawer 200 may be used as a simple storage space for keeping tableware or food. Alternatively, in some cases, an electric heater may be provided to the drawer 200. In this case, the drawer 200 may be used as a cooking space for heating or cooking food. The drawer 200 may be configured to be inserted or withdrawn by a user.

When the drawer 200 is inserted into the cabinet 110, show can be generated as the drawer 200 hits the cabinet 100. In particular, when a user pushes the drawer 200 to close, a shock may be generated from the drawer 200 at a position when the drawer 200 is fully closed.

In some cases, the shock may cause a problem in that a vessel accommodated in the drawer 200 may be distressed or a problem that food put in the vessel may be damaged. To help mitigate such shock, the drawer 200 may be configured as detailed in the following description.

Figure 3:
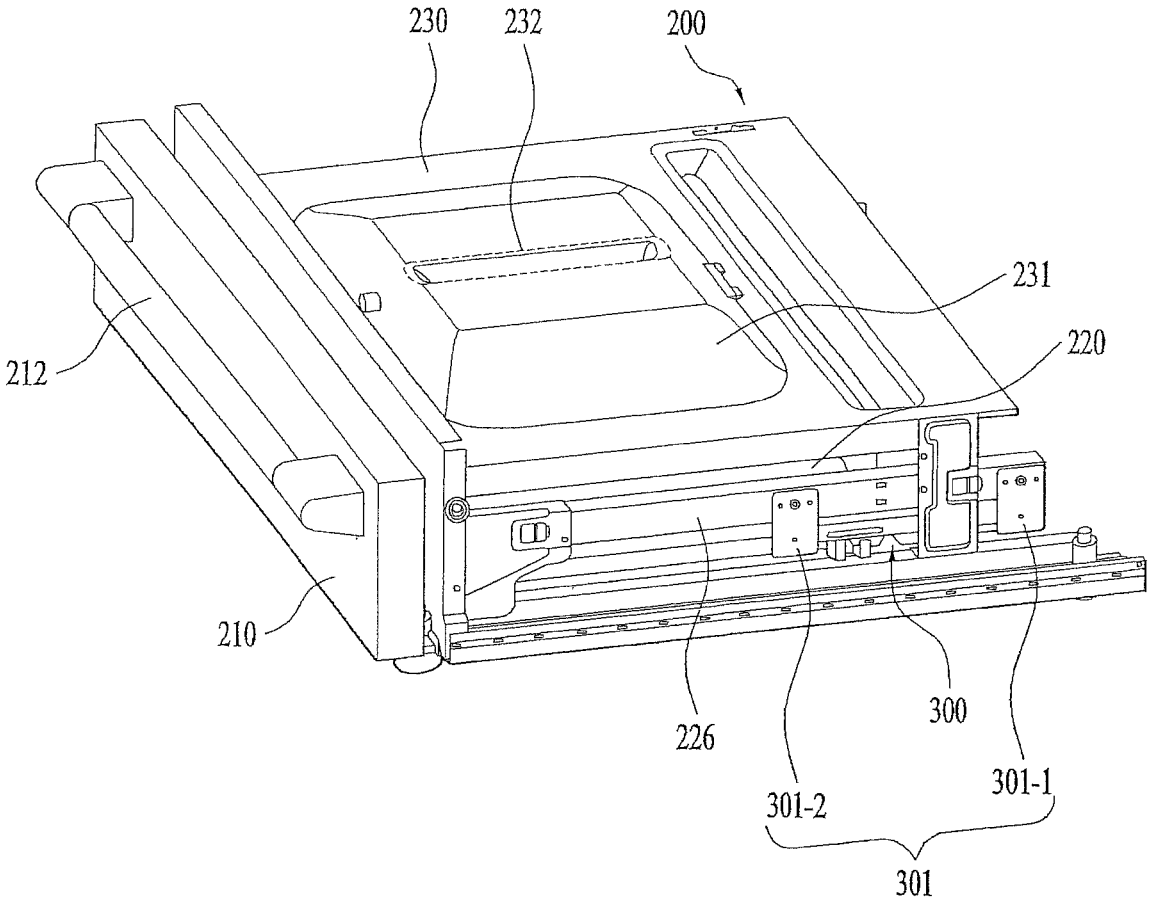
FIG. 3 is a perspective view of an example drawer provided to the cooking appliance shown in FIG. 2.

Referring to both FIG. 2 and FIG. 3, the drawer 200 provided to the cooking appliance 100 according to the implementation of the present disclosure may be provided in a manner of being entered in or withdrawn from the cabinet under the first cooking unit 120 and the second cooking unit 140 mentioned in the foregoing description.

Alternatively, it is a matter of course that the drawer 200 can be provided between the first cooking unit 120 and the second cooking unit 140. In particular, the disposition of the drawer 200 can be changed according to design specifications.

Moreover, the drawer 200 may be configured to enable food to be heated or cooked using a heat source in a cooking space formed inside the drawer 200.

As illustrated, the drawer 200 may include a front panel 210 provided to a front side of the drawer 200, a handle part 212 provided to the front panel 210, a lateral panel 20 configured to form both width-directional lateral sides of the drawer 200, and a rear panel provided to a rear side of the drawer 200. Hence, by gripping the handle part 212, a user can insert the drawer 200 into the cabinet 110 or withdraw the drawer 200 from the cabinet 110.

A top panel 230 configured to cover a top side of the drawer 200 can be fixed to the cabinet 110. In this case, a heater installation seat 231 can be formed in the top panel 230 in a manner of being convex upward. Additionally, a heater 232 can be installed in the heater installation seat 231. Hence, when the drawer 200 is inserted or withdrawn, the top panel 230 can be maintained stationary without moving.

The cooking appliance 100 may include a damping module 300 configured to absorb a closing shock of the drawer 200 on inserting the drawer 200 into the cabinet 110.

The damping module 300 may be configured to enable the drawer 200 to be automatically closed by being pulled in a closing direction as well as to enable a closing shock of the drawer 200 to be absorbed until fully closing the drawer 200 from a preset insertion position of the drawer 200.

In particular, when the drawer 200 is inserted into the cabinet 110, the damping module 300 can be configured to absorb the closing shock of the drawer 200 until the drawer 200 is fully closed from the preset insertion position (i.e., during a state between a fully withdrawn state of the drawer 200 and a fully inserted state of the drawer 200).

The preset insertion position may be determined to be somewhere between the fully withdrawn (i.e., open) state of the drawer 200 and the fully inserted (i.e., closed) state of the drawer 200.

The damping module 300 may be configured to enable the drawer 200 to be automatically closed by being pulled in a closing direction. In particular, the damping module 300 can be configured to pull the drawer 200 in the closing direction until the drawer 200 is fully closed from the preset insertion position. Hence, the drawer 200 can be automatically closed by the damping module 300 from the preset insertion position to the fully closed state.

With reference to the related drawings together with FIG. 3, the configuration for inserting and withdrawing the drawer 200 and the relation between the drawer 200 and the damping module 300 are described in detail as follows.

Figure 4:
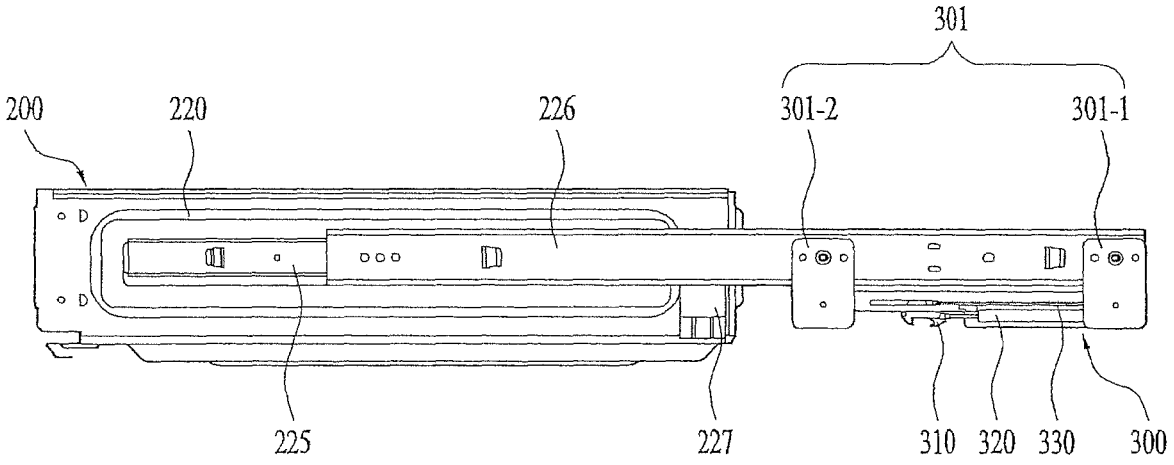
FIG. 4 is a side view of an example slider and guide part for inserting/withdrawing the drawer shown in FIG. 3 into/from a cabinet.

FIG. 4 shows an example of a slider and guide part for inserting/withdrawing a drawer into/from a cabinet.

Referring to both FIG. 3 and FIG. 4, a slider 225 can be provided to both width-directional lateral sides of the drawer 200. In particular, the slider 225 can be installed on both of the width-directional lateral sides of the drawer 200 along a length direction of the drawer 200. For example, the slider 225 can be installed on the lateral panel 220 of the drawer 200 to extend along the length direction of the drawer 200. Moreover, a guide part 226 can be provided to the cabinet 100 so as to guide the slider 225 to be slidable.

In some cases, the guide part 226 can be installed so as to extend in forward-backward direction within the cabinet 110. For example, the guide part 226 can be installed at a location corresponding to the slider 225 on a width-directional inner lateral side of the cabinet 110. The guide part 226 can be installed at a location corresponding to the slider 225 on an inner side of the cabinet 110. The slider 225 can be configured to be slidable along the guide part 226. For instance, a space for inserting and withdrawing the slider 225 can be formed in the guide part 26.

Hence, the slider 225 can be configured to slide along a length direction of the guide part 226. In particular, the slider 225 can be configured to slide in forward-backward direction along the guide part 226. In this case, the slider 225 and the guide part 226 can be aligned so that a length-directional center line of the slide 225 and a length-directional center line of the guide part 226 can match each other.

The damping module 300 can be provided to one side of the guide part 226 in parallel with the guide part 226. For instance, the damping module 300 can be connected to the guide part 226 at a rear portion of the guide part 226 with reference to the length-directional center of the guide part 226.

Moreover, the damping module 300 may be disposed under the guide part 26 in a manner of being spaced apart from the guide part 226 in a preset interval. In this case, at least one of both length-directional end portions of the damping module 300 and the guide part 226 can be fixed to each other by at least one fixing bracket 301 to maintain the preset interval.

In particular, the fixing bracket 301 can enable a parallel relation to be maintained between at least one of the length-directional end portions of the damping module 300 and the guide part 226. Hence, malfunction of the damping module 300 due to a mismatch of the alignment between the damping module 300 and the guide part 226 by an external shock can be prevented or mitigated by the fixing bracket 301.

In some cases, each of both of the length-directional end portions of the damping module 300 can be fixed to the guide part 226 at a location corresponding to the guide part 226 by the fixing bracket 301.

According to the implementation shown in the drawings, the fixing bracket 301 may include a first fixing bracket 301-1 and a second fixing bracket 301-2.

In this case, one length-directional end portion of the damping module 300 may be fixed to a rear end of the guide part 226 by the first fixing bracket 301-1. Moreover, the other length-direction end portion of the damping module 300 may be fixed to a preset location between the front end portion and the rear end portion of the guide part 226 by the second fixing bracket 301-2.

For instance, the second fixing bracket 301-2 may be formed to connect the other length-directional end portion of the damping module 300 and the guide part 226 to each other at a preset location of the rear of the guide part 226 with reference to the length-directional center of the guide part 226.

As each of the front end portion and the rear end portion of the damping module 300 are fixed to the guide part 226, although there is an external shock, the parallel relation between the damping module 300 and the guide part 226 can be maintained.

In some cases, a link member 227 may be provided to the slider 225 (refer to FIG. 4]. For instance, the link member 227 may be formed to extend downward from the slider 225.

Moreover, the link member 227 may be provided to a preset location along the length direction of the slider 225. For instance, the link member 227 may be formed to extend from the rear end portion of the slider 225 in a downward direction from the slider 225.

Moreover, the damping module 300 may have a holding member 310 configured to engage with the link member 227 selectively at a preset insertion position of the drawer 200. In particular, the preset insertion position of the drawer 200 may be a position at which the link member 227 and the holding member 310 meet each other in the course of inserting the drawer 200.

In more detail, when the drawer 200 is inserted (i.e., when the drawer 200 is closed), the link member 227 and the holding member 310 can engage with each other at the preset insertion position.

Hence, from the preset insertion position to the fully closed state of the drawer 200, the damping module 300 is able to apply a force of pulling the drawer 200 in order to absorb the shock generated from closing the drawer 200 and to enable the drawer 200 to be automatically closed.

On the contrary, when the drawer 200 is withdrawn (i.e., when the drawer 200 is opened), the link member 227 and the holding member 310 can be separated from each other at the preset insertion position (also referred to as "preset withdrawal position").

In particular, the damping module 300 may further include a hydraulic damper 320 configured to absorb the closing shock of the drawer 200 and an elastic unit 330 disposed in parallel with the hydraulic damper 320. The hydraulic damper 320 may be configured to absorb the closing shock of the drawer 200 from the preset insertion position of the drawer 200 to the fully closed state of the drawer 200.

Moreover, the elastic unit 330 may be configured to pull the drawer 200 in a closing direction at the preset insertion position of the drawer 200. In particular, the elastic unit 330 can be configured to pull the drawer toward a rear direction of the cooking appliance from the preset insertion position of the drawer 200 to the fully closed state of the drawer 200.

In this case, a front end portion of the hydraulic damper 320 and a front end portion of the elastic unit 330 can be fixed to the holding member 310 mentioned in the foregoing description. Hence, while the link member 27 and the holding member 310 engage with each other, the damping module 300 can be configured to absorb the closing shock of the drawer 200 and to pull the drawer 200 toward the rear direction of the home appliance.

Therefore, as the drawer 200 is automatically closed by the damping module 300 from the preset insertion position to the fully closed state, the closing shock of the drawer 200 can be absorbed.

In the following description, a structure and operational principle of the damping module 300 are described in detail with reference to the related drawings.

Figure 5:
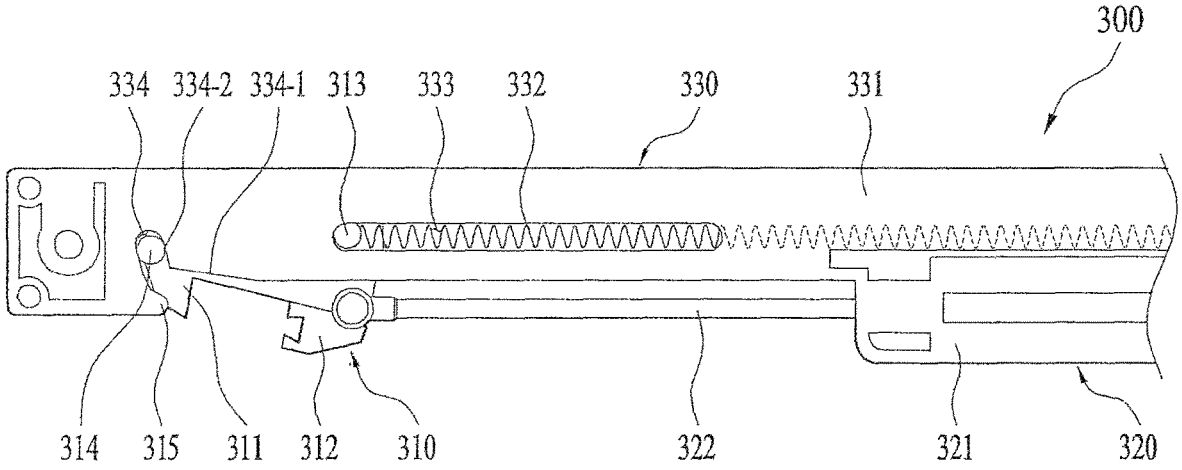
FIG. 5 shows a schematic diagram of an example damping module in a state when the drawer has been withdrawn.
Figure 6:
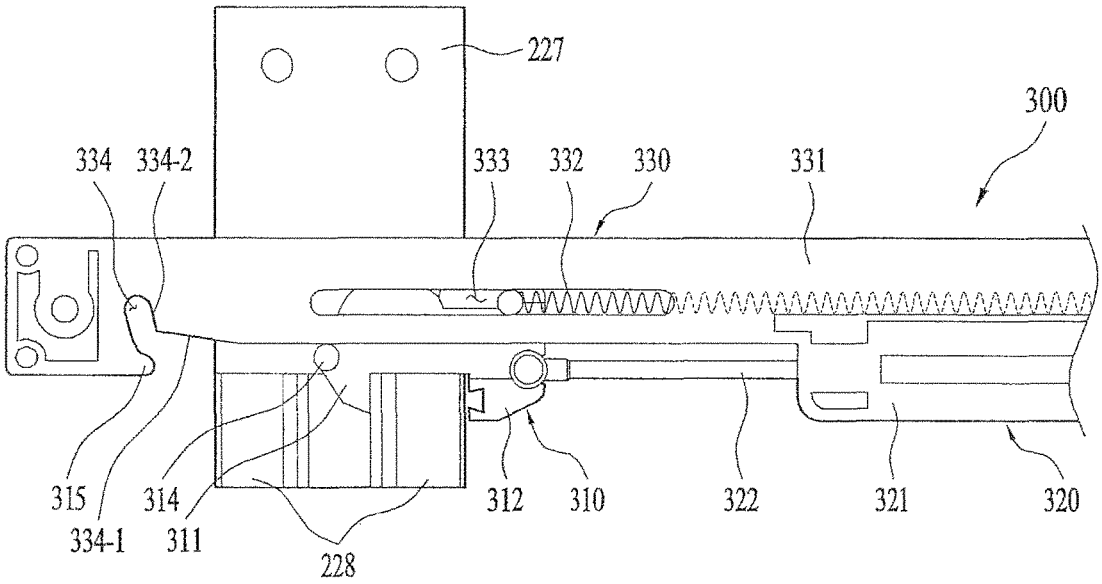
FIG. 6 shows a schematic diagram of the damping module shown in FIG. 5 during the course of inserting the drawer.

FIG. 5 shows the damping module in a state that a drawer has been withdrawn, and FIG. 6 shows the damping module in the course of inserting a drawer. In particular, FIG. 5 shows a state in which the drawer 200 is further withdrawn than the preset insertion position, and, FIG. 6 shows the state in which the drawer 200 is being inserted over the preset insertion position.

Referring to both FIG. 5 and FIG. 6, the hydraulic damper 320 may include a first body 321 and a piston rod 322 configured to reciprocate in and out of the first body 321. A working fluid may be accommodated in the first body 321. Since many damping operations through interaction between the piston rod 32 and the working fluid are well-known, their details shall be omitted from the following description.

In some cases, the elastic unit 330 may include a second body 331 and an elastic member 332 accommodated in at least one portion of the second body 331. In this case, the elastic member 332 may include a tension spring. Moreover, the first body 321 and the second body 331 can be integrally formed with each other.

A first guide slot 333 may be formed in the second body 331 to guide a first projection 313 provided to the holding member 310. In particular, the first projection 313 configured to be projected in a width direction of the holding member 310 may be provided to the holding member 310. Additionally, the first guide slot 333 configured to guide the first projection 313 at a position corresponding to the first projection 313 can be formed in the second body 331.

In this case, the first guide slot 333 can be formed to extend in a preset length along a length direction of the damping module 300. Hence, the holding member 310 can move in forward-backward direction by a length of the first guide slot 333.

In some cases, a second guide slot 334 configured for the link member 227 to be selectively locked to or separated from the holding member 310 may be formed in a front end portion of the second body 331. Moreover, a second projection 314 configured to be selectively inserted in or withdrawn from the second guide slot 334 may be provided to the holding member 310.

In particular, the second guide slot 334 may be formed in form of a slit through which the second projection 314 can be inserted and withdrawn. In more detail, the second guide slot 334 may include a first inclined plane 334-1 inclined upward at a preset first inclination angle with reference to a virtual line in parallel with the guide part 226 mentioned in the foregoing description and a second inclined plane 334-2 inclined downward at a preset second inclination angle from a front of the first inclined plane 334-1.

In this case, the second inclination angle of the second inclined plane 334-2 is preferably greater than the first inclination angle of the first inclined plane 334-1.

Meanwhile, in order to prevent the second projection 314 from being separated upward from the second guide slot 334, the second body 331 may include a protruding portion 315 configured to cover at least one portion of an upper side of the second inclined plane 334-2.

In particular, the protruding portion 315 can be configured to protrude from the upper side of the second inclined plane 334-2 toward a bottom direction of the second body 331. Hence, while the second projection 314 is inserted in the second guide slot 334, it is able to prevent the second projection 314 from being unnecessarily separated from the second guide slot 334 by an external shock.

In the following description, a structure and operation for locking and separating the holding member 310 and the link member 227 are described in detail.

First, a first locking portion 311 and a second locking portion 312 may be provided to the holding member 310. The first locking portion 311 and the second locking portion 312 may be spaced apart from each other in a preset interval along a length direction of the holding member 310. The first locking portion 311 and the second locking portion 312 may be formed to be projected downward by being spaced apart from each other in the preset interval.

The link member 227 may be provided with a third locking portion 228 configured to engage between the first locking portion 311 and the second locking portion 312. In particular, the link member 227 can be provided with the third locking portion 228 configured to engage between the first locking portion 311 and the second locking portion 312 at the preset insertion position of the drawer 200.

The link member 227 can be provided with a pair of the third locking portions 228 that are spaced apart from each other in a preset interval. In this case, a pair of the third locking portions 228 can be configured symmetric to each other with reference to a center axis traversing the link member 227 in top-bottom direction. This can enable the link member 227 to be compatible in being used in width-directional right and left lateral sides of the drawer 200. Moreover, the second projection 314 mentioned in the foregoing description may be provided to a front end of the first locking portion 311.

Referring to FIG. 5, in a state that the drawer 200 fails to be inserted into the preset insertion position, the second projection 314 is maintained in a state of being inserted into the second guide slot 334. In doing so, the elastic member 332 is maintained in an extended state and the piston rod 322 is also maintained in a state of being extended to the maximum.

On the other hand, while the drawer 200 is fully closed, each of the elastic member 332 and the piston rod 322 is in a state of maximum contraction. Moreover, as the second projection 314 is inserted into the second guide slot 334, the first locking portion 311 of the holding member 310 may not interfere in a progress of the link member 227.

Referring to FIG. 6, at the preset insertion position of the drawer 200, a rear end of the third locking portion 228 provided to the link member 227 pushes the second locking portion 312 of the holding member 310 so that the second projection 314 can be withdrawn from the second guide slot 334. In doing so, the damping module 320 can absorb the closing shock of the drawer as soon as the drawer 200 connected to the link member 227 is pulled toward the rear side of the cooking appliance by the elastic member 332.

Meanwhile, when the drawer 200 having been fully closed is withdrawn, while the drawer 200 is withdrawn to the preset withdrawal position, the third locking portion 228 of the link member 227 engages between the first locking portion 311 and the second locking portion 312 so that the holding member 310 and the link member 227 can be maintained in a mutually engaging state.

In doing so, at the preset withdrawal position of the drawer 200, the link member 227 can be separated from the holding member 310 as soon as the second projection 314 of the holding member 310 is inserted into the second guide slot 334.

In particular, at the preset withdrawal position of the drawer 200, as the second projection 314 is inserted into the second guide slot 334, the first locking portion 311 is inclined upward. Hence, at the preset withdrawal position of the drawer 200, as the second projection 314 is inserted into the second guide slot 334, the first locking portion 311 does not interfere in a progress of the link member 227 toward a front side of the cooking appliance.

The preset insertion position and the preset withdrawal position mentioned in the above description may indicate a position for withdrawing the second projection 314 from the second guide slot 334 and a position for inserting the second projection 314 into the second guide slot 334. In particular, the preset insertion position and the preset withdrawal position may be identical to each other.

Meanwhile, according to the foregoing description, in the state when the drawer 200 is fully closed, the holding member 310 and the link member 227 should be maintained in the locked state. In particular, in the fully closed state of the drawer 200, the third locking portion 228 should be locked between the first locking portion 311 and the second locking portion 312.

But in some cases, before the rear end of the third locking portion 228 pushes the second locking portion 312, it may be the case that the second projection 314 is separated from the second guide slot 334 by an external shock or the like. In such a case, since the holding member 310 and the link member 227 are separated from each other in the fully closed state of the drawer 200, the damping module 300 may be unable to perform an original function of its own.

In the following description, a structure and operational principle for restoring a function of the damping module 300 in the event of the second projection 314 being separated from the second guide slot 334 by an external shock or the like are described with reference to the related drawings.

Figure 7:
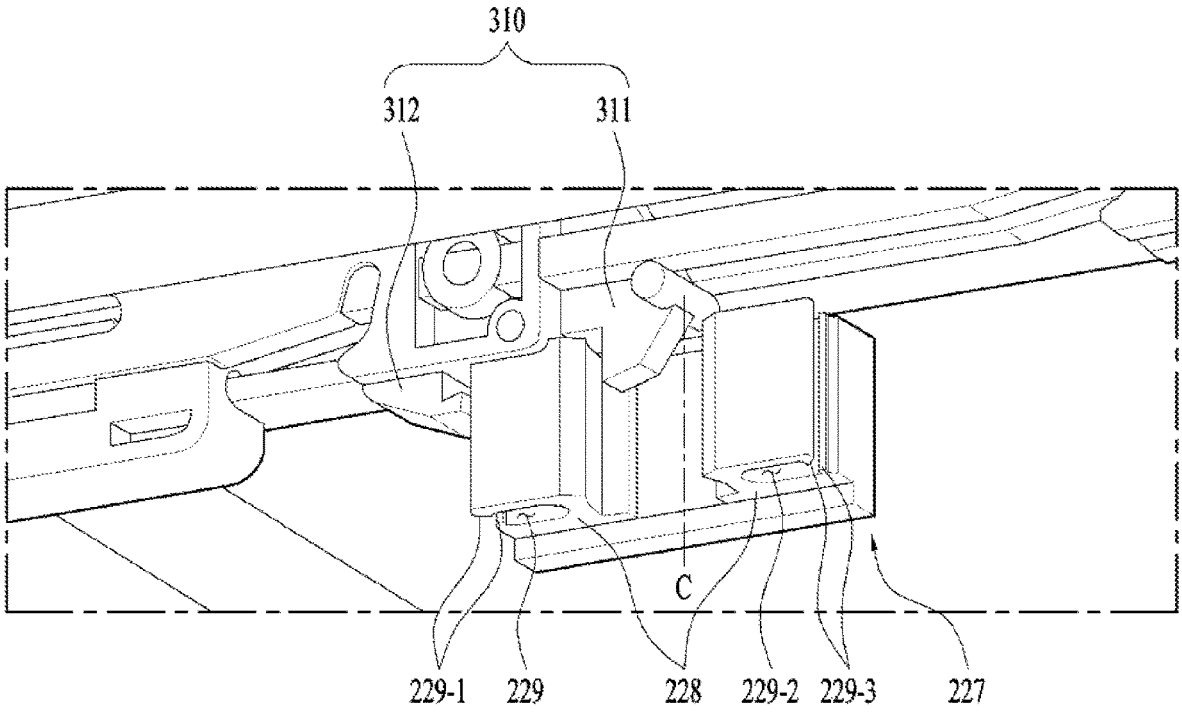
FIG. 7 is a schematic diagram showing an example state when a link member provided to a slider of the drawer and a holding member provided to the damping module are locked.
Figure 8:
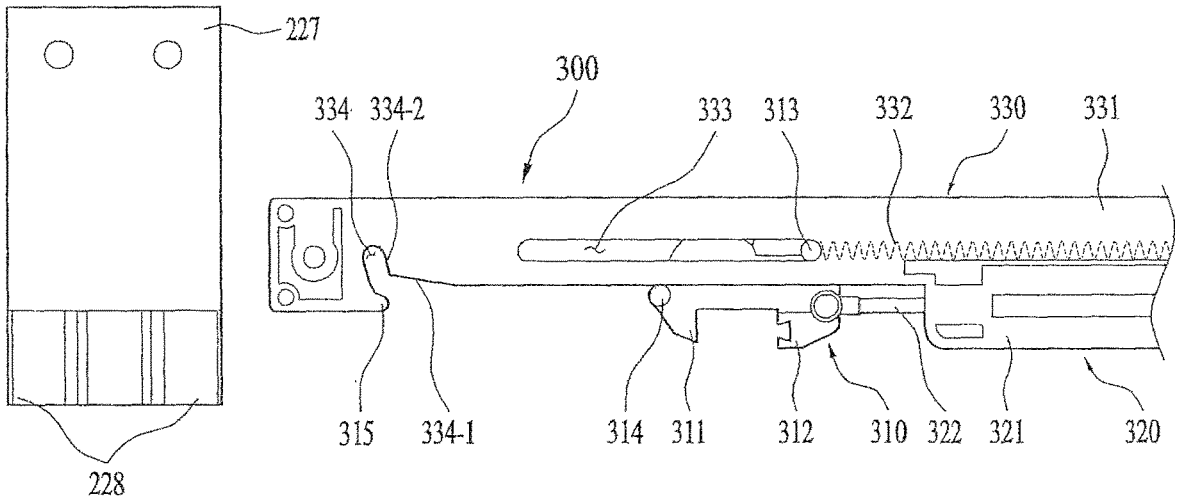
FIG. 8 is a schematic diagram showing an example state when the link member is released from the holding member.
Figure 9:
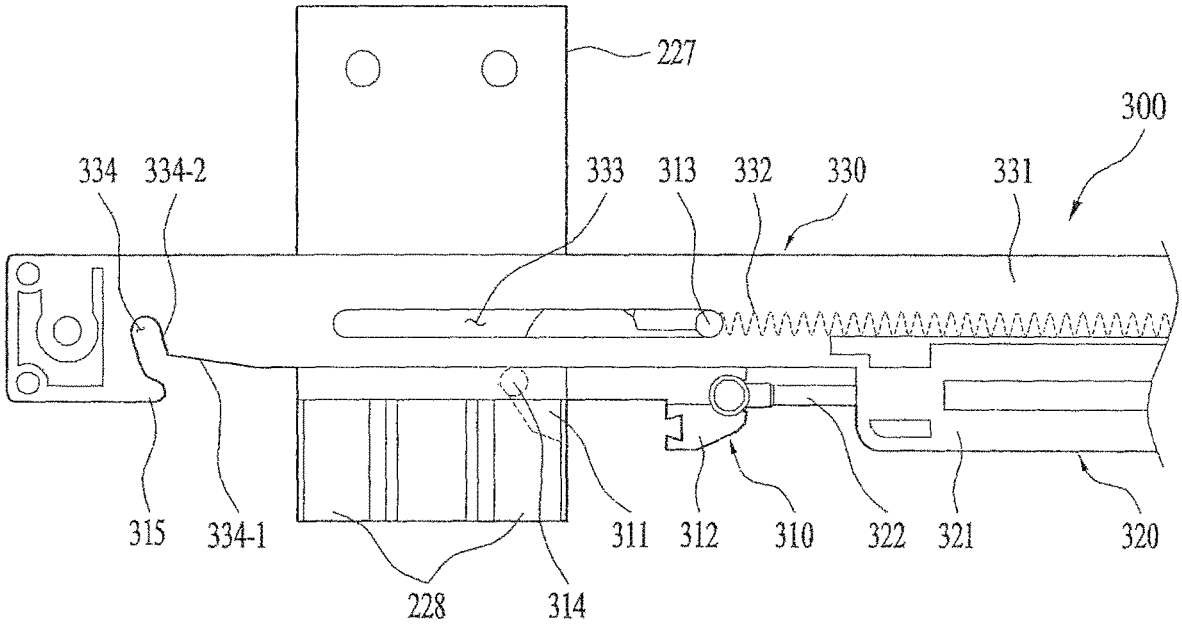
FIG. 9 is a schematic diagram to showing an example state when the holding member is locked to the link member by shrink fit.

FIG. 7 shows the state in which a link member provided to a slider of a drawer and a holding member provided to a damping module are locked. FIG. 8 shows the state in which a link member is released from a holding member. FIG. 9 shows the state in which a holding member is locked to a link member by a shrink fit.

Referring to FIG. 7, the third locking portion 228 of the link member 227 can be configured to selectively engage between the first and second locking portions 311 and 312 of the holding member 310.

A pair of the third locking portions 228 may be provided to the link member 227 in a manner of being spaced apart from each other in a preset interval. In this case, a pair of the third locking portions 228 may be configured to be symmetric to each other with reference to a center line C that traverses the link member 227 in top-bottom direction.

In particular, a pair of the third locking portions 228 can be provided to both length-directional end portions of the link member 227 so as to be symmetric to each other, respectively, with reference to the center line C that traverses the link member 227 in the top-bottom direction at a length-directional center of the link member 227.

Moreover, a fit slit 229 or 229-2 configured to penetrate the third locking portion 228 in top-bottom direction may be formed in the third locking portion 228.

In this case, a pair of inclined portions 229-1 and 229-3 inclined toward the fit slit 229 or 229-2 can be provided to entrance sides of the fit slit 229 and 229-2. For instance, a pair of third locking portions 228 can be provided to the front end portion and the rear end portion of the link member 227, respectively. Also, the inclined portions 229-1 and 229-3 can be formed at each of the front and rear end portions of the link member 227.

The fit slit 229 or 229-2 and the inclined portions 229-1 and 229-3 are provided for the restoration of the function of the damping module 300 through a shrink fit that will be described in the following.

Referring to FIG. 8, before the link member 227 is locked to the holding member 310 at the preset insertion position of the drawer 200, the second projection 314 provided to the holding member 310 may be separated from the second guide slot 334 by an external shock or the like.

In this case, when the drawer 200 is to be closed, the damping module 300 is unable to perform an original function from the preset insertion position of the drawer 200 to the fully closed state of the drawer 200. Hence, in order for the damping module 300 to perform an original function, it may be necessary for the second projection 314 provided to the holding member 310 to be inserted to the second guide slot 334 by pulling the holding member 310 in a front direction.

Referring to FIG. 7 and FIG. 9 together, a fit slit 229 or 229-2 can be provided to the third locking portion 228 so that the first locking portion 311 can be fitted along a length direction of the third locking portion 228 by a shrink fit.

While the third locking portion 228 is separated from a position between the first locking portion 311 and the second locking portion 312, the drawer 200 is closed. In this case, if the drawer 200 is pushed in a closing direction, the first locking portion 311 is locked in the fit slit 229 or 229-2. Hence, the link member 227 and the holding member 310 can engage with each other.

Moreover, the inclined portions 229-1 and 229-3 provided to the fit slit 229 and 229-2 may be configured in a manner that the first locking portion 311 easily enters the fit slit 229 or 229-2 but has difficulty in escaping from the fit slit 229 or 229-2.

For instance, of the inclined portions 229-1 and 229-3 can be formed to be inclined in a direction for of the inclined portions 229-1 and 229-3 to get closer to each other toward an inner side of the fit slit 229 or 229-2.

In this case, a width between of the inclined portions 229-1 and 229-3 is formed smaller than that of the first locking portion 311 and a width of the inner side of the fit slit 229 or 229-2 may be formed greater than that of the second locking portion 312. Hence, the first locking portion 311 can be fitted into the fit slit 229 or 229-2 by the shrink fit via the inclined portion 229-1 and 229-3. Moreover, owing to the inclined portions 229-1 and 229-3, it is difficult for the first locking portion 311 to be separated toward an outer side of the fit slit 229 or 229-2.

Yet, as the second projection 314 provided to the holding member 310 is inserted into the second guide slot 334 at the preset withdrawal position, since a side of the first locking portion 311 of the holding member 310 is inclined upward, the holding member 310 and the link member 227 can be separated from each other. That is, although the second projection 314 of the holding member 310 is not withdrawn from the second guide slot 334 by the link member 227, the second projection 314 may be withdrawn from the second guide slot 334 by an external shock or the like.

In doing so, the holding member 310 may return to a maximally contracted position by the elastic member 332 connected to the holding member 310. In particular, the holding member 310 deviates from the preset insertion position and then moves backward. Hence, when the drawer 200 is inserted, since the link member 227 and the holding member 310 cannot be locked to each other at the preset insertion position, the damping module 300 is unable to perform an original function of its own.

In this case, while the drawer 200 is closed, if the drawer 200 is pushed in a closing direction (i.e., toward a rear side of the cooking appliance, the first locking portion 311 provided to the holding member 310 can be fitted into the fit slit 229 or 229-2 of the link member 227 by the shrink fit. In particular, the holding member 310 and the link member 277 can be locked to each other.

In such a state, if a user pulls the drawer 200 to withdraw again, the holding member 310 moves toward the front side of the cooking appliance while locked to the link member 277. Subsequently, as the second projection 314 provided to the holding member 310 is inserted into the second guide slot 334 at the preset withdrawal position (i.e., preset withdrawal position), the holding member 310 and the link member 227 can be separated from each other.

In particular, the holding member 310 does not interfere in the movement of the link member 277 from the preset withdrawal position to a state that the drawer 200 is fully open. A subsequent operation of the damping module 300 can normally work in the same manner as described with reference to FIGS. 3 to 6.

It will be appreciated by those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A cooking appliance, comprising:

a cabinet that defines an exterior of the cooking appliance;

a cooking unit located within the cabinet, the cooking unit being configured to perform cooking using a first heat source;

a drawer located under the cooking unit, the drawer being configured to perform cooking using a second heat source and to be inserted in and withdrawn from the cabinet;

a damping module configured to absorb a closing shock transmitted to the drawer during the insertion of the drawer into the cabinet from a preset insertion position to a fully inserted position;

a slider located at each of both lateral sides of the drawer;

a guide part located within the cabinet and configured to guide the slider to thereby allow sliding movement between the slider and the guide part; and a link member located at the slider, wherein the damping module comprises a holding member that is configured to selectively engage with the link member at the preset insertion position of the drawer and an elastic unit that is configured to move the drawer in a closing direction from the preset insertion position to the fully inserted position, wherein the elastic unit comprises a second body and an elastic member accommodated in at least one portion of the second body, wherein the second body defines a second guide slot that is located at a front end portion of the second body and that is configured to enable the link member to be selectively locked to or separated from the holding member, wherein the holding member comprises a first locking portion and a second locking portion that are spaced apart from each other in a preset interval along a length direction of the holding member, and a second projection that is located at a front end of the first locking portion and that is configured to be selectively inserted into or withdrawn from the second guide slot, wherein the link member comprises a third locking portion configured to engage between the first locking portion and the second locking portion at the preset insertion position of the drawer, wherein the second projection is configured to be withdrawn from the second guide slot based on a rear end of the third locking portion of the link member pushing the second locking portion at the preset insertion position of the drawer, wherein the rear end of the third locking portion defines a slit configured to receive the first locking portion to enable the first locking portion to be fitted into the slit along a length direction of the third locking portion, and wherein the slit of the third locking portion and the first locking portion of the holding member are configured to, in an event when the second projection is separated from the second guide slot by an external shock, engage with each other as the drawer is pushed in the closing direction before the rear end of the third locking portion of the link member pushes the second locking portion at the preset insertion position of the drawer.

2. The cooking appliance of claim 1, wherein the damping module is configured to absorb the closing shock of the drawer during the insertion of the drawer from the preset insertion position to the fully inserted position, and wherein the damping module is configured to automatically close the drawer by moving the drawer in the closing direction.

3. The cooking appliance of claim 1, wherein the damping module is provided at one side of the guide part and is oriented to be parallel with the guide part.

4. The cooking appliance of claim 3, wherein the damping module and the guide part are spaced apart from each other by a preset interval, and wherein at least one end portion of both end portions of the damping module and the guide part are fixed to each other by at least one fixing bracket to maintain the preset interval.

5. The cooking appliance of claim 4, wherein each of the end portions of the damping module is fixed to a location corresponding to the guide part by the at least one fixing bracket.

6. The cooking appliance of claim 5, wherein the at least one fixing bracket comprises a first fixing bracket and a second fixing bracket, wherein a first end portion of the damping module is fixed to a rear end portion of the guide part by the first fixing bracket, and wherein a second end portion of the damping module is fixed to a preset location between a front end portion and the rear end portion of the guide part by the second fixing bracket.

7. The cooking appliance of claim 1, wherein the damping module further comprises:

a hydraulic damper configured to absorb the closing shock of the drawer during the insertion of the drawer from the preset insertion position to the fully inserted position, wherein the elastic member is oriented to be parallel with the hydraulic damper, and wherein a front end portion of the hydraulic damper and a front end portion of the elastic unit are fixed to the holding member.

8. The cooking appliance of claim 7, wherein the hydraulic damper comprises a first body and a piston rod configured to reciprocate in and out of the first body, and wherein a first guide slot having a preset length is defined in the second body to guide a first projection provided at the holding member.

9. The cooking appliance of claim 8, wherein the first body and the second body are integrally formed with each other.

10. The cooking appliance of claim 1, wherein the second guide slot includes a first inclined plane inclined at a preset first inclination angle with reference to a virtual line in parallel with the guide part and a second inclined plane inclined upward at a preset second inclination angle from a front end of the first inclined plane, and wherein the second inclination angle of the second inclined plane is greater than the first inclination angle of the first inclined plane.

11. The cooking appliance of claim 1, wherein, while the drawer is being withdrawn from a fully closed state to a preset withdrawal position, and as the third locking portion engages between the first locking portion and the second locking portion, the holding member and the link member are configured to maintain a mutually locked state, and wherein, in a state in which the drawer is disposed at the preset withdrawal position, and as the second projection of the holding member is inserted into the second guide slot and the first locking portion allows the third locking portion to move in a direction opposite to the closing direction, the link member is configured to be separated from the holding member.

12. The cooking appliance of claim 11, wherein the preset insertion position is a position at which the second projection is inserted into the second guide slot, wherein the preset withdrawal position is a position at which the second projection is withdrawn from the second guide slot, and wherein the preset insertion position and the preset withdrawal position are identical to each other.

13. The cooking appliance of claim 1, wherein the third locking portion is symmetrically provided to each of both end portions of the link member with reference to a center of the link member.

* * * * *